US010043464B2

(12) United States Patent
Watanabe et al.

(10) Patent No.: US 10,043,464 B2
(45) Date of Patent: Aug. 7, 2018

(54) CONTROL DEVICE, DISPLAY DEVICE, AND CONTROL METHOD

(71) Applicant: Sharp Kabushiki Kaisha, Osaka-shi, Osaka (JP)

(72) Inventors: Tatsuo Watanabe, Osaka (JP); Kenji Maeda, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 124 days.

(21) Appl. No.: 14/783,593

(22) PCT Filed: Mar. 31, 2014

(86) PCT No.: PCT/JP2014/059534

§ 371 (c)(1),
(2) Date: Oct. 9, 2015

(87) PCT Pub. No.: WO2014/171323

PCT Pub. Date: Oct. 23, 2014

(65) Prior Publication Data

US 2016/0086557 A1 Mar. 24, 2016

(30) Foreign Application Priority Data

Apr. 18, 2013 (JP) ..... 2013-087811

(51) Int. Cl.
*G09G 3/36* (2006.01)
*G09G 3/20* (2006.01)

(52) U.S. Cl.
CPC ..... *G09G 3/3618* (2013.01); *G09G 3/2007* (2013.01); *G09G 3/3648* (2013.01);
(Continued)

(58) Field of Classification Search
CPC .. G09G 3/3618; G09G 3/2007; G09G 3/3648; G09G 2320/0252; G09G 2310/027
See application file for complete search history.

(56) References Cited

U.S. PATENT DOCUMENTS 8,334,857 B1 * 12/2012 Ogrinc ..... G09G 5/377 345/204
8,692,822 B2 * 4/2014 Yanagi ..... G09G 5/18 345/211

(Continued)

FOREIGN PATENT DOCUMENTS

JP 2006-126475 A 5/2006
JP 2009-251607 A 10/2009

(Continued)

OTHER PUBLICATIONS

Official Communication issued in International Patent Application No. PCT/JP2014/059534, dated Jun. 24, 2014.

*Primary Examiner* — Benyam Ketema
(74) *Attorney, Agent, or Firm* — Keating & Bennett, LLP

(57) ABSTRACT

Provided is a display device capable of suppressing electric power consumption as well as displaying an image with excellent quality. A host control section (30) in accordance with an aspect of the present invention includes: an image determining section (35) for determining whether or not an image has a characteristic of causing flicker to be easily recognizable; and a driving changing section (36) for, in a case where it is determined that the image has the characteristic of causing flicker to be easily recognizable, determining that (i) a display of the image is to be refreshed at a first refresh rate during a first period and (ii) the display of the image is to be refreshed at a different second refresh rate during a second period.

11 Claims, 8 Drawing Sheets

(52) U.S. Cl.
CPC ... *G09G 2310/027* (2013.01); *G09G 2310/08* (2013.01); *G09G 2320/0247* (2013.01); *G09G 2320/0252* (2013.01); *G09G 2330/021* (2013.01); *G09G 2340/0435* (2013.01); *G09G 2360/16* (2013.01)

(56) References Cited

U.S. PATENT DOCUMENTS

| | | | | |
|---|---|---|---|---|
| 2006/0092120 | A1* | 5/2006 | Nose | G09G 3/3614 345/98 |
| 2009/0251445 | A1* | 10/2009 | Ito | G09G 3/3648 345/204 |
| 2010/0277490 | A1* | 11/2010 | Nam | G06F 3/147 345/581 |
| 2011/0157252 | A1* | 6/2011 | Yamazaki | G02F 1/133555 345/690 |
| 2011/0205254 | A1* | 8/2011 | Umezaki | G09G 3/3648 345/690 |
| 2014/0112086 | A1* | 4/2014 | Park | G11C 11/408 365/222 |
| 2014/0152533 | A1* | 6/2014 | Imada | G09G 3/3648 345/89 |
| 2015/0043294 | A1* | 2/2015 | Yang | G11C 7/02 365/222 |
| 2015/0287352 | A1* | 10/2015 | Watanabe | G09G 3/20 345/89 |

FOREIGN PATENT DOCUMENTS

| | | | |
|---|---|---|---|
| WO | 03/009272 | A1 | 1/2003 |
| WO | 2011/102248 | A1 | 8/2011 |
| WO | 2014/050316 | A1 | 4/2014 |
| WO | 2014/080731 | A1 | 5/2014 |

* cited by examiner

CONTROL DEVICE, DISPLAY DEVICE, AND CONTROL METHOD

TECHNICAL FIELD

The present invention relates to a control device, a display device, and a control method.

BACKGROUND ART

In recent years, thin, light, and low-power-consumption display devices such as liquid crystal display devices have been remarkably widespread. Typical examples of apparatuses on which to mount such display devices encompass mobile phones, smartphones, laptop PCs (Personal Computers). It is expected that in the future, development and prevalence of electronic paper, which is an even thinner display device, will be rapidly advanced. Under such circumstances, it is a common challenge to reduce power consumption of display devices.

According to conventional CG (Continuous Grain) silicon TFT liquid crystal display panels, amorphous silicon TFT liquid crystal display panels, and the like, it is necessary to refresh a screen at 60 Hz. Therefore, for a reduction in electronic power consumption of the conventional liquid crystal display panels, attempts have been made to achieve a refresh rate lower than 60 Hz.

Patent Literature 1 discloses a liquid crystal display configured such that in a case where no stripes are present in an image over a series of frames, the liquid crystal display device (i) determines that the frames have no characteristic that easily induces flicker and then (ii) lowers a refresh rate.

CITATION LIST

Patent Literature

[Patent Literature 1]
Japanese Patent Application Publication Tokukai No. 2009-251607 (Publication date: Oct. 29, 2009)

SUMMARY OF INVENTION

Technical Problem

However, with liquid crystal display panels employing CG silicon TFTs or amorphous silicon TFTs, it is only possible to lower a refresh rate to 50 Hz at best while maintaining display quality.

In recent years, diligent attempts have been made to develop an oxide semiconductor liquid crystal display panel in which TFTs are each composed of an oxide semiconductor that uses indium (In), gallium (Ga), and zinc (Zn). According to a TFT composed of an oxide semiconductor, only a small amount of electric current leaks in an off state. Therefore, unlike the cases of conventional liquid crystal panels, it is unnecessary for an oxide semiconductor liquid crystal display panel to refresh a screen at 60 Hz, and it is therefore possible to lower a refresh rate to approximately 1 Hz. This allows for a reduction in electric power consumption.

However, in a case where response speed of liquid crystals is slow, driving a display device at a low refresh rate poses a problem of causing flicker to be easily recognizable due to non-uniform pixel capacitances or the like. Since slow response speed of liquid crystals causes an alignment status of liquid crystals to change over a period in which a screen is not refreshed, changes in grayscale levels can be easily recognizable. In addition, electric charge leaks from pixels via TFTs in an off state. Therefore, in a case where pixel capacitance is not uniform, a change in pixel potential differs from pixel to pixel.

Patent Literature 1 discloses a technique related to setting of a refresh rate. However, the technique makes it impossible to fully achieve both a reduction in electric power consumption and prevention of flicker.

According to an aspect of the present invention, it is possible to realize a display device capable of suppressing electric power consumption as well as displaying an image with excellent quality.

Solution to Problem

A control device in accordance with an aspect of the present invention is a control device for a display device, the control device including: an image determining section for determining whether or not an image has a characteristic of causing flicker to be easily recognizable; and a refresh rate determining section for, in a case where the image determining section determines that the image has the characteristic of causing flicker to be easily recognizable, for a first period and a second period that are included in a display period in which the image is displayed, the first period being followed by the second period, determining (i) that a display of the image is to be refreshed at a first refresh rate during the first period and (ii) that the display of the image is to be refreshed at a second refresh rate during the second period, the second refresh rate being different from the first refresh rate.

A control method in accordance with an aspect of the present invention is a method for controlling a display device, the method including the steps of: (a) determining whether or not an image has a characteristic of causing flicker to be easily recognizable; and (b) in a case where it is determined in the step (a) that the image has the characteristic of causing flicker to be easily recognizable, for a first period and a second period that are included in a display period in which the image is displayed, the first period being followed by the second period, determining (i) that a display of the image is to be refreshed at a first refresh rate during the first period and (ii) that the display of the image is to be refreshed at a second refresh rate during the second period, the second refresh rate being different from the first refresh rate.

Advantageous Effects of Invention

An aspect of the present invention makes it possible to efficiently achieve both prevention of recognition of flicker and a reduction in electric power consumption. Therefore, it is possible to realize a display device capable of suppressing electric power consumption as well as displaying an image with excellent quality.

DESCRIPTION OF EMBODIMENTS

Embodiment 1

Figure 2:
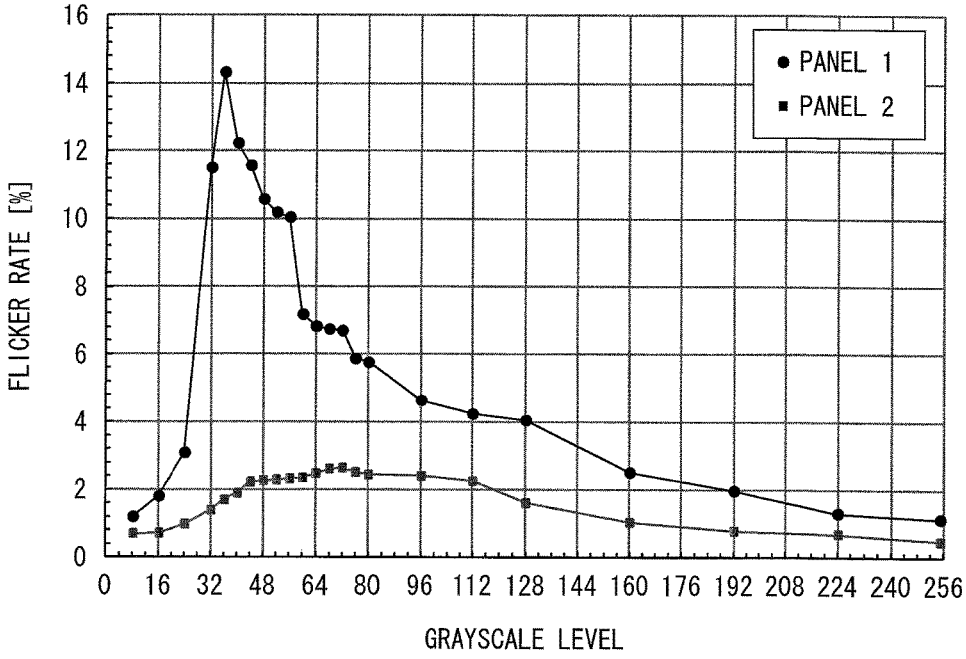
FIG. 2 is a graph showing flicker rates corresponding to respective grayscale levels at which an oxide semiconductor liquid crystal display panel is driven with a refresh rate of 1 Hz.

FIG. 2 is a graph showing flicker rates corresponding to respective grayscale levels at which an oxide semiconductor liquid crystal display panel is driven with a refresh rate of 1 Hz. A flicker rate indicates a degree to which flicker is recognizable, and a larger value of the flicker rate means greater recognizability of the flicker. A flicker rate of 1.5%, for example, is one indicator of whether or not flicker can be easily recognizable. In a case where the oxide semiconductor liquid crystal display panel is driven at a low refresh rate, it is a grayscale level of an image that determines whether or not flicker easily occurs. In FIG. 2, a minimum grayscale level (black) is 0, whereas a maximum grayscale level (white) is 255. Note that recognizability of flicker also varies, depending on a screen size and production process. A panel 1 is a liquid crystal display panel greater in size than a panel 2. The panel 1 and the panel 2 also differ in production process.

A response speed of liquid crystals at intermediate grayscale levels is relatively slow. In addition, at the intermediate grayscale levels, a change in grayscale level (change in alignment of liquid crystal molecules) as a result of leakage of electric charge via TFTs can easily occur. Note that "intermediate grayscale levels" refer to all grayscale levels except for saturated grayscale levels (i.e., maximum grayscale level and the minimum grayscale level). For example, where the minimum grayscale level and the maximum grayscale level are 0 and 255, respectively, grayscale levels falling within a range of grayscale level 1 to grayscale level 254 are intermediate grayscale levels. In a case of a normally-black type, flicker is more easily recognizable in a range of, for example, grayscale level 10 to grayscale level 200 of all the intermediate grayscale levels. Furthermore, flicker is even more easily recognizable in a range of grayscale level 20 to grayscale level 80, and is particularly easily recognizable in a range of grayscale level 40 to grayscale level 60. For example, in a case where an image including a large number of pixels having grayscale levels of the above described ranges is displayed at a refresh rate of 1 Hz, a screen is refreshed every second. This may cause a user to recognize flicker every second. Display of such an image at a refresh rate of 15 Hz to 60 Hz makes it possible to prevent recognition of flicker but makes it impossible to sufficiently reduce electric power consumption.

In view of this, in a case where an image includes a large number of pixels having grayscale levels falling within a predetermined range, i.e., in a case where the image is an image (flickering image) having a characteristic of causing flicker to be easily recognizable, a refresh rate is gradually changed. This makes it possible to achieve both a reduction in electric power consumption and prevention of flicker. Note that the grayscale levels (flickering grayscale levels) falling within the predetermined range are set in advance as grayscale levels which fall within a range of intermediate grayscale levels and at each of which flicker easily occurs.

(Configuration of Display Device 1)

Figure 1:
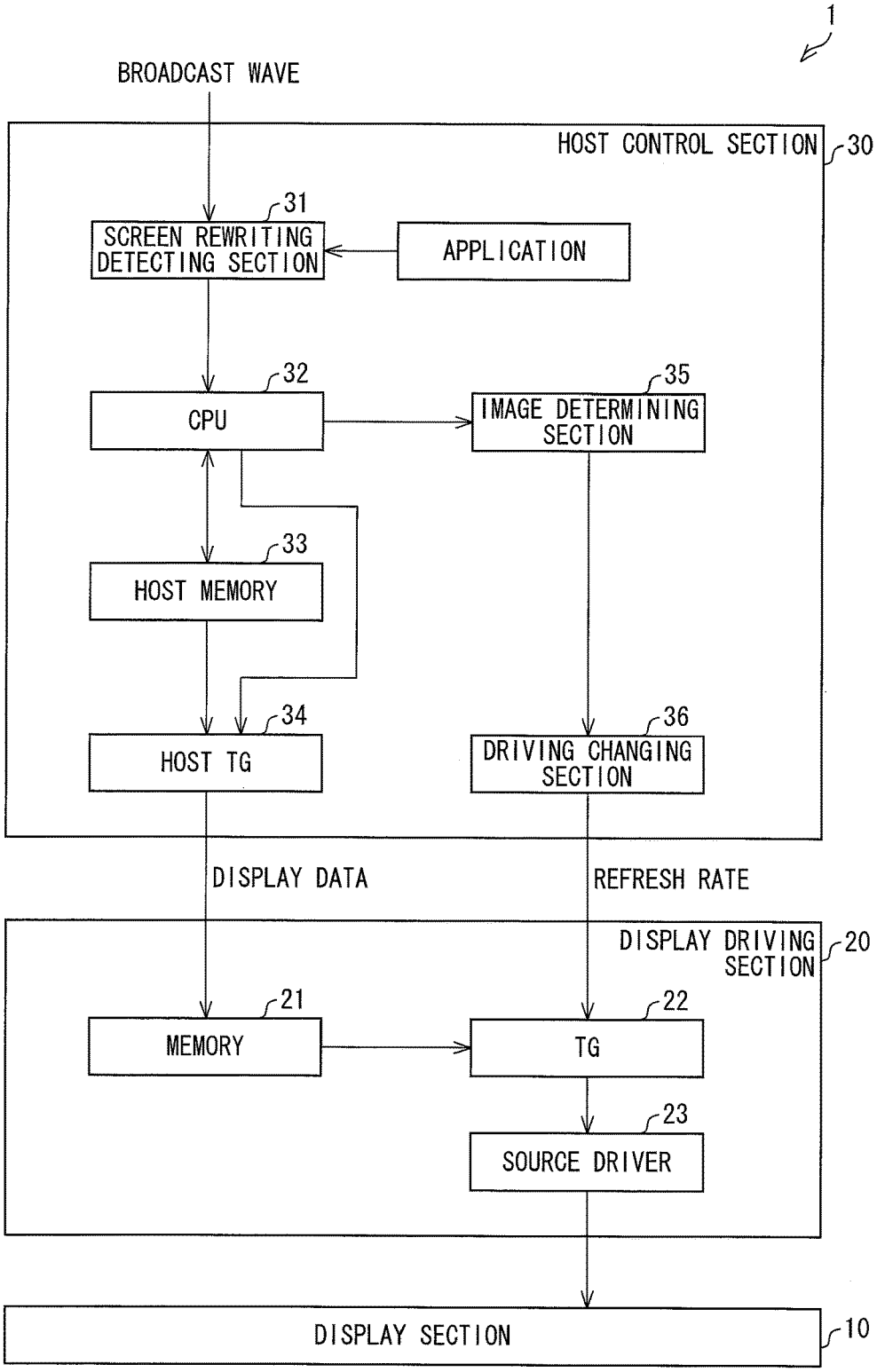
FIG. 1 is a block diagram illustrating a configuration of a display device in accordance with an embodiment of the present invention.

FIG. 1 is a block diagram illustrating a configuration of a display device in accordance with an embodiment of the present invention. A display device 1 includes a display section 10, a display driving section 20, and a host control section 30 (control device).

The display section 10 includes a screen, and is constituted by, for example, an oxide semiconductor liquid crystal display panel serving as an active matrix liquid crystal display panel. The oxide semiconductor liquid crystal display panel is a liquid crystal display panel in which the above-described oxide semiconductor-TFT is used as each switching element provided so as to correspond to one or more of a plurality of pixels that are two dimensionally arranged. The oxide semiconductor-TFT is a TFT having a semiconductor layer composed of an oxide semiconductor. Examples of the oxide semiconductor encompass an oxide semiconductor (In—Ga—Zn—O) in which an oxide of indium, gallium, and zinc is used. According to the oxide semiconductor-TFT, (i) an amount of electric current flowing in an on state is large and (ii) an amount of leak current in an off state is small. Therefore, by using the oxide semiconductor-TFT for a switching element, it is possible to increase a pixel aperture ratio and to reduce a refresh rate of image display to approximately 1 Hz. Reducing the refresh rate allows for such an effect as a reduction in electric power consumption. An increase in a pixel aperture ratio brings about such an effect as causing a display of an image to be brighter. In a case where the brightness of image display is to be set equal to that of a CG silicon liquid crystal display panel or the like, an increased pixel aperture ratio brings about such an effect as reducing electric power consumption by decreasing a light intensity of a backlight.

(Configuration of Host Control Section 30)

The host control section 30 includes a screen rewriting detecting section 31 (rewriting detection section), a CPU 32, a host memory 33, a host TG 34 (host timing generator), an image determining section 35, and a driving changing section 36 (refresh rate determining section). The host control section 30 is configured by, for example, a control circuit provided on a substrate.

The screen rewriting detection section 31 evaluates whether or not content displayed on the screen of the display section 10 needs to be rewritten. For example, the screen rewriting detection section 31 notifies the CPU 32 of necessity to rewrite content (an image) displayed on the screen in cases such as (i) a case where an application, which was launched and is being run within the display device 1, notifies the screen rewriting detection section 31 that displayed content needs to be rewritten, (ii) a case where a user of the display device 1 notifies, via an input section, the screen rewriting detection section 31 that displayed content needs to be rewritten, and (iii) a case where the screen rewriting detection section 31 is notified of the necessity to rewrite displayed content due to data streaming via the Internet, a broadcast wave, or the like.

Note that display data inputted in the screen rewriting detection section 31 includes (i) an image of a flame in which displayed content is to be rewritten and (ii) a display rewriting flag (time reference) indicative of a timing with which to display the image data. In a case where content of an image is not changed over a plurality of frames, data in frames in which the content of the image is not changed is not included in the display data. Based on the display rewriting flag, the screen rewriting detection section 31 can detect the necessity to rewrite displayed content. The screen rewriting detection section 31 supplies the display rewriting flag and the display data to the CPU 32.

Note that in a case where the display data inputted in the screen rewriting detection section 31 does not include a display rewriting flag but includes data on all frames, the screen rewriting detection section 31 can determine, by comparing an image in a given frame and an image in a following frame, whether or not content of the image is changed. Based on a result of the comparison, the screen rewriting detection section 31 can detect necessity to rewrite displayed content.

The CPU 32 (i) obtains, from the screen rewriting detection section 31, the display data on one entire screen and then (ii) writes the display data into the host memory 33. The CPU 32 also supplies the display data to the image determining section 35. The CPU 32 also supplies the rewriting flag to the host TG 34.

The host memory 33 is a storage device configured by a VRAM (Video Random Access Memory) or the like.

When the host TG 34 receives the rewriting flag from the CPU 32, the host TG 34 (i) obtains the display data from the host memory 33 and (ii) transfers the display data to the display driving section 20. Only in a case where a display of an image needs to be rewritten, the host TG 34 transfers, to the display driving section 20, display data on the image is to be rewritten in a frame. The host TG 34 transfers the display data in accordance with data communication specifications of a mobile device, such as MIPI (Mobile Industry Processor Interface). Note that the host TG 34 transfers, to the display driving section 20, a sync signal along with the display data.

The image determining section 35 determines whether or not an image based on the display data is an image (flickering image) having a characteristic of causing flicker to be easily recognizable. Specifically, the image determining section 35 determines whether or not pixels in the image have grayscale levels falling within a range (first range) of grayscale level 20 to grayscale level 80. The image determining section 35 determines a percentage of pixels, of all pixels falling within a predetermined region, which have grayscale levels falling within the first range. Specifically, the image determining section 35 (i) generates a histogram in which pixels of every 10 grayscale levels are categorized into a corresponding one of classes and (ii) determines, based on the histogram, a percentage of pixels having grayscale levels within the first range. Although the predetermined region is herein assumed to be an entire region of the image, the predetermined region can be a partial region of the image. The image determining section 35 determines whether or not the percentage of the pixels having grayscale levels within the first range is equal to or higher than 30% (first threshold value). In a case where the percentage is equal to or higher than 30%, the image determining section 35 determines that the image has the characteristic of causing flicker to be easily recognizable. In a case where the percentage is lower than 30%, the image determining section 35 determines that the image does not have the characteristic of causing flicker to be easily recognizable. The image determining section 35 supplies, to the driving changing section 36, a determined result indicative of whether or not the percentage of the pixels having grayscale levels within the first range is equal to or higher than the first threshold value (i.e., whether or not the image has the characteristic of causing flicker to be easily recognizable). Values of the first range and the first threshold value are illustrative only, and can be other values.

According to the determined result of the image determining section 35, the driving changing section 36 determines the refresh rate of the display section 10. In a case where the percentage of pixels having grayscale levels within the first range is lower than the first threshold value in an image, the driving changing section 36 determines that the display section 10 displays the image at a first refresh rate (1 Hz) throughout an entire display period in which the image is displayed. In a case where the percentage of pixels having grayscale levels within the first range is equal to or higher than the first threshold value in an image, the driving changing section 36 determines that the display section 10 displays the image by switching among a plurality of refresh rates during the display period in which the image is displayed. Specifically, the driving changing section 36 determines that the display section 10 (i) displays the image at a first refresh rate (1 Hz) during the earliest predetermined period (first period) of the display period in which the image is displayed, (ii) displays the image at a second refresh rate (30 Hz) during a predetermined period (second period), which follows the first period, of the display period in which the image is displayed, and (iii) displays the image at a third refresh rate (1 Hz) during a predetermined period (third period), which follows the second period, of the display period in which the image is displayed. That is, the display section 10 displays the image at a higher refresh rate during the second period than during the first period and the third period. According to Embodiment 1, the first period and the third period are identical in refresh rate, but may be different in refresh rate. In accordance with a start of each of the first period, the second period, and the third period, the driving changing section 36 instructs the display driving section 20 to drive the display section 10 at a refresh rate thus determined.

(Configuration of Display Driving Section 20)

The display driving section 20 is, for example, a so-called COG driver and is mounted on a glass substrate of the display section 10 by use of a COG (Chip on Glass) technique. The display driving section 20 drives the display section 10 to cause the screen to display an image based on display data. The display driving section 20 includes a memory 21, a TG 22 (timing generator), and a source driver 23.

The memory 21 stores the display data transferred from the host control section 30. The memory 21 then retains the display data until the display of the image is rewritten (i.e. retains the display data unless the content of the image is changed).

Based on the refresh rate instructed by the host control section 30, the TG 22 reads out the display data from the memory 21, and supplies the display data to the source driver 23. Further, in a case where the content of the image is changed (i.e., in a case where the display data is transferred from the host control section 30 to the display driving section 20), the TG 22 reads out the display data from the memory 21 regardless of the refresh rate, and supplies the display data to the source driver 23. The display device 1 can rewrite a screen at a maximum of 60 Hz in accordance with, for example, a rate at which a moving image is rewritten. In addition, the TG 22 generates a timing signal for driving the display section 10 at the refresh rate thus instructed, and supplies the timing signal to the source driver 23. Note that, for generating the timing signal, the TG 22 can utilize the sync signal supplied from the host TG.

In accordance with the timing signal, the source driver 23 writes, into the pixels of the display section 10, respective display voltages corresponding to the display data.

Suitable examples of the display device 1 encompass display devices that place importance particularly on portability, such as mobile phones, smartphones, notebook-sized PCs, tablet devices, e-book readers, and PDAs.

(Display Driving Method)

Figure 3:
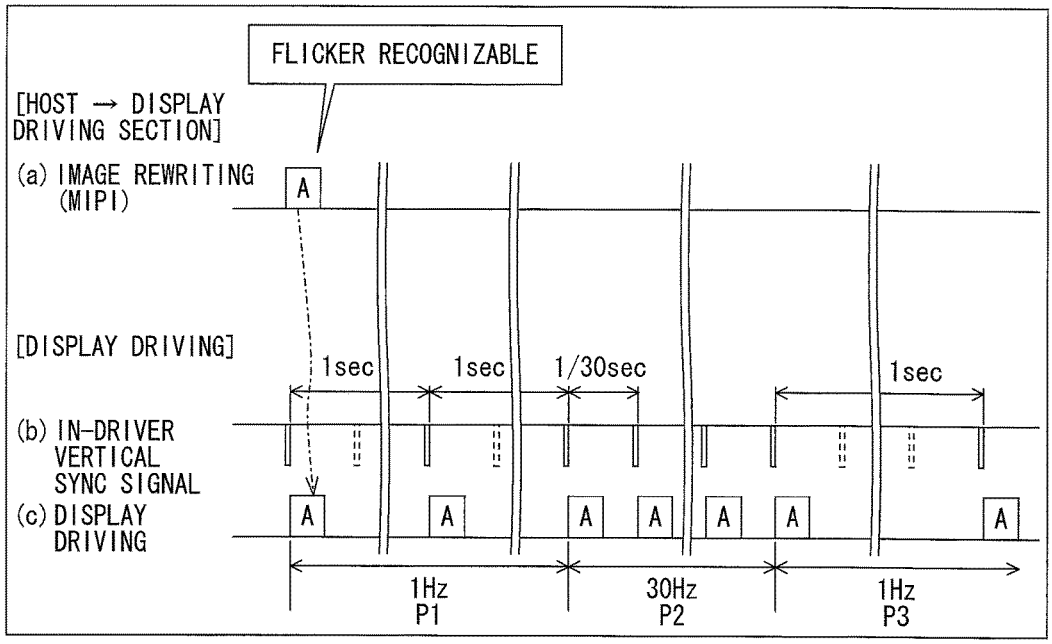
FIG. 3 is a timing chart showing how the display device displays a still image.

FIG. 3 is a timing chart showing how the display device 1 displays a still image. FIG. 3 illustrates a case where a still image A is displayed. The image A is a flickering image (i) which includes a first threshold value (30%) or a higher percentage of pixels which have grayscale levels falling within a first range (grayscale level of 20 to grayscale level 80) and (ii) which has a characteristic of causing flicker to be easily recognizable.

The host control section 30 transfers display data (image A) on one entire screen to the display driving section 20 only when content of a screen is changed (see (a) of FIG. 3). After the display data on the image A is transferred, it is when the displayed content is rewritten to another image that the host control section 30 transfers display data to the display driving section 20 next.

The display driving section 20 (i) stores the received display data (image A) in the memory 21 and (ii) rewrites, with a timing synchronized with an in-driver vertical sync signal illustrated in (b) of FIG. 3, the image displayed on the display section 10 to the image A (see (c) of FIG. 3). The in-driver vertical sync signal is generated by the TG 22 in accordance with a timing with which to receive the display data and an instructed refresh rate. Note that the description of a delay time between a point in time where the display driving section 20 receives the display data and a point in time where the image is displayed will be omitted. A pulse shown by dotted lines indicates points in time where vertical sync signals are not generated.

Then, during a first period P1, which is the earliest period, of a display period in which the image A is displayed, a display of the image A is refreshed every second (at 1 Hz). Specifically, the display driving section 20 operates such that the TG 22 reads out display data (the image A) from the memory 21 every second, and then the source driver 23 supplies the display data to the display section 10. During a second period P2, which follows the first period P1, of the display period in which the image A is displayed, the display of the image A is refreshed every 1/30 seconds (at 30 Hz). Further, during a third period P3, which follows the second period P2, of the display period in which the image A is displayed, the display of the image A is refreshed every second (at 1 Hz). For example, the first period P1 lasts two seconds to three seconds after the image A starts to be displayed, the second period P2 lasts seven seconds to eight seconds after the first period P1, and the third period P3 lasts after the second period until the image A is rewritten to another image.

Figure 4:
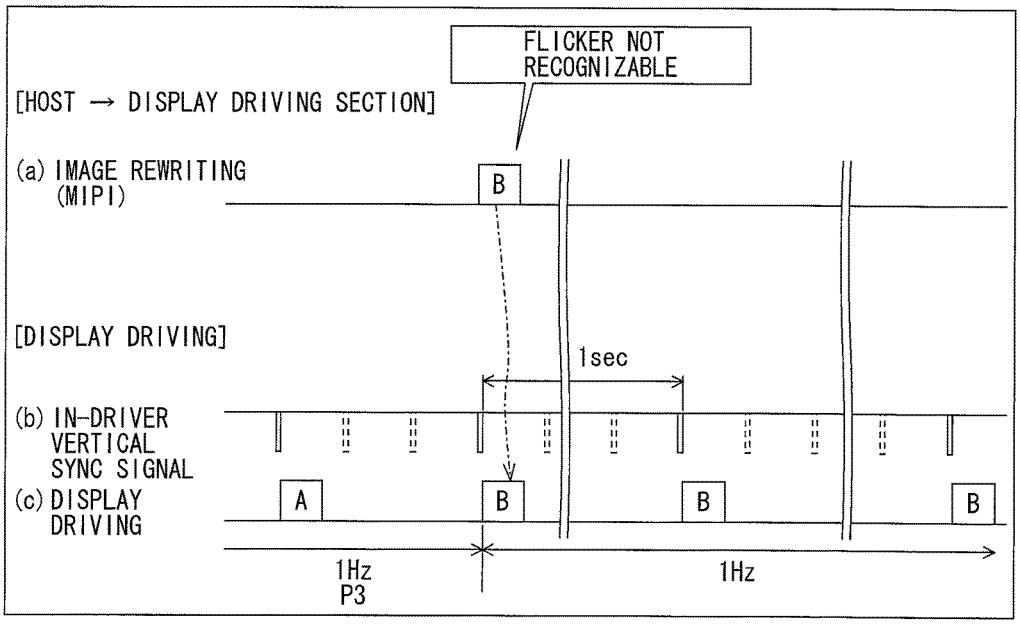
FIG. 4 is a timing chart showing how a display device 1 displays an image B, which is different from an image A, after the image A.

FIG. 4 is a timing chart showing how the display device 1 displays another image B after displaying the image A. The image B includes less than the first threshold value of pixels which have grayscale levels falling within the first range, and has no characteristic of causing flicker to be easily recognizable. The display driving section 20 which has received display data indicative of the image B rewrites the image displayed on the display section 10 to the image B regardless of a refresh rate. Then, a display of the image B is refreshed at a low refresh rate (1 Hz) throughout an entire display period in which the image B is displayed. A display of an image which has no characteristic of causing flicker to be easily recognizable is thus refreshed at a fourth refresh rate (1 Hz) lower than the second refresh rate (30 Hz) at which the display of the image is refreshed during the second period.

Note that the first period P1 and the second period P2 can each have any length that is set in accordance with an intended method by which the display device is to be used.

(Flow 1 of Process of Determining Refresh Rate)

Figure 5:
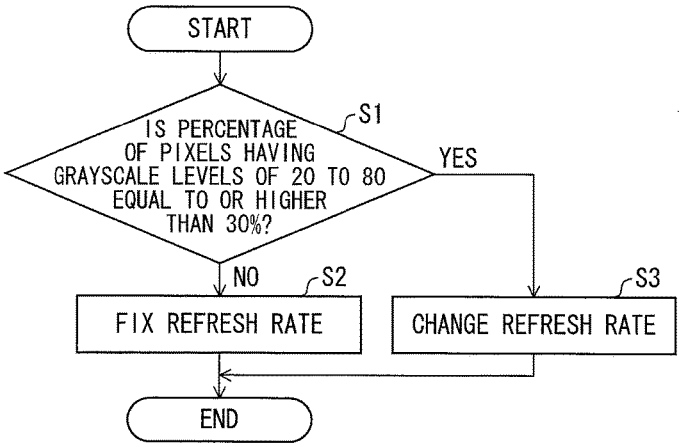
FIG. 5 is a view showing a flow chart of a process in which a host control section of the display device determines a refresh rate.

FIG. 5 is a view showing a flow chart of a process in which the host control section 30 determines a refresh rate. The flow illustrated in FIG. 5 is carried out each time the screen rewriting detection section 31 detects rewriting of a display of an image (i.e. detects a change in content of the image).

The image determining section 35 determines a percentage of pixels, of all pixels included in the image, which have grayscale levels falling within a first range (range of grayscale level 20 to grayscale level 80). Then, the image determining section 35 determines whether or not the percentage is equal to or higher than a first threshold value (30%) (S1).

In a case where the percentage of the pixels having grayscale levels within the first range is lower than the first threshold value (30%) (No in S1), the driving changing section 36 fixes the refresh rate at 1 Hz during a display period in which the image is displayed (S2).

In a case where the percentage of the pixels having grayscale levels within the first range is equal to or higher than the first threshold value (30%) (Yes in S1), the driving changing section 36 changes the refresh rate during the display period in which the image is displayed (S3).

(Effect of Display Device 1)

In order to display a flickering image in which flicker is easily recognizable, the display device 1 of Embodiment 1 displays the flickering image by changing a refresh rate during a display period in which the flickering image is displayed. After the flickering image is displayed, a certain period of time is required before a user can recognize flicker in the displayed flickering image. During the first period P1 (e.g., a period of two seconds to three seconds), which is the earliest period in which the user cannot recognize flicker, the display device 1 refreshes the flickering image at a low refresh rate (e.g., equal to or lower than 15 Hz). During the second period P2, which follows the first period P1, the display device 1 refreshes the flickering image at a high refresh rate (e.g., higher than 15 Hz) so as to prevent recognition of flicker. After a certain period of time (e.g., a period of 10 seconds) has elapsed since the image was changed, the user is most likely to no longer carefully view the display of the image. Thus, during the third period P3 (a period that lasts after 10 seconds have elapsed from the change of the image), the display device 1 refreshes the flickering image at a low refresh rate (e.g., equal to or lower than 15 Hz) so as to reduce electric power consumption. The display device 1 thus changes a refresh rate in accordance with a human visual characteristic so as to display the flickering image. This allows the display device 1 to efficiently achieve both prevention of recognition of flicker and a reduction in electric power consumption. Therefore, with the display device 1, it is possible to reduce electric power consumption while maintaining high display quality.

Further, in a case where an image has no characteristic of causing flicker to be easily recognizable, the display device 1 fixes a refresh rate at a low refresh rate (e.g., equal to or lower than 15 Hz). This allows for a further reduction in electric power consumption.

According to the display device 1, the display driving section 20 refreshes an image during a period in which the image is not changed. This makes it unnecessary for the host control section 30 to transfer an image to the display driving section 20. The host control section 30 only needs to instruct the display control section 20 to change a refresh rate at respective ends of the first period and the second period. This allows the host control section 30 to pause its operation at least during the third period P3. A significant effect of reducing electric power consumption can be obtained as a result of the host control section 30 pausing its operation.

Modification

A single picture element includes R, G, and B pixels. In the example above, the image determining section 35 determines the percentage of pixels, of all pixels in an image, which have grayscale levels within the first range, regardless of colors of the pixels (RGB).

Alternatively, the image determining section 35 can determine (i) respective percentages of R, G, and B pixels having grayscale levels within a first range and (ii) determine respective weighted values of the percentages. In such a case, the image determining section 35 determines whether or not a sum of the weighted values is equal to or higher than a predetermined threshold value. Degrees to which a person can recognize R, G, and B colors are generally said to be in a ratio of 3:6:1. That is, a person generally clearly recognizes G (green) pixels. This means that flicker is easily recognizable if a large number of G pixels have grayscale levels within the first range. Therefore, the image determining section 35 determines (i) a percentage Rr of R (red) pixels, of all R pixels in a predetermined region of the image, which have grayscale levels within the first range, (ii) a percentage Rg of G pixels, of all G pixel in the predetermined region, which have grayscale levels within the first range, and (iii) a percentage Rb of B pixels, of all B pixels in the predetermined region, which have grayscale levels within the first range. Then, the image determining section 35 determines, as the sum of the weighted values, a value obtained by $(3\times Rr)+(6\times Rg)+(1\times Rb)$. In a case where the sum is equal to or higher than a predetermined threshold value (e.g., a value obtained by $(3+6+1)\times 30[\%]$), the image determining section 35 can determine that flicker is easily recognizable in the image.

Alternatively, whether or not the image is an image having a characteristic of causing flicker to be easily recognizable can be determined by the image determining section 35, based on luminances Y of respective picture elements determined from R, G, and B grayscale levels. Specifically, the image determining section 35 determines the luminances Y of the respective picture elements where, for example, luminance Y=R grayscale×0.29891+G grayscale×0.58661+B grayscale×0.11448. In a case where a luminance Y of a corresponding one of the picture elements falls within a predetermined range (e.g. 20 to 80), the image determining section 35 can determine that pixels included in the picture element have grayscale levels within the first range. That is, in a case where a percentage of picture elements having luminances Y falling within the predetermined range is equal to or higher than a first threshold value (30%), a refresh rate is changed by a predetermined method so that flicker is prevented from being recognized. In such a case, since the image determining section 35 only needs to store a histogram indicative of luminances Y of the picture elements, a storage capacity only needs to be approximately ⅓ of a storage capacity required in a case where the image determining section 35 stores a histogram indicative of grayscale levels of the respective pixels.

Embodiment 2

The following description will discuss another embodiment of the present invention. For convenience, members similar in function to those described in the foregoing embodiment will be given the same reference signs, and their description will be omitted. Embodiment 2 differs from Embodiment 1 in method of changing a refresh rate.

Figure 6:
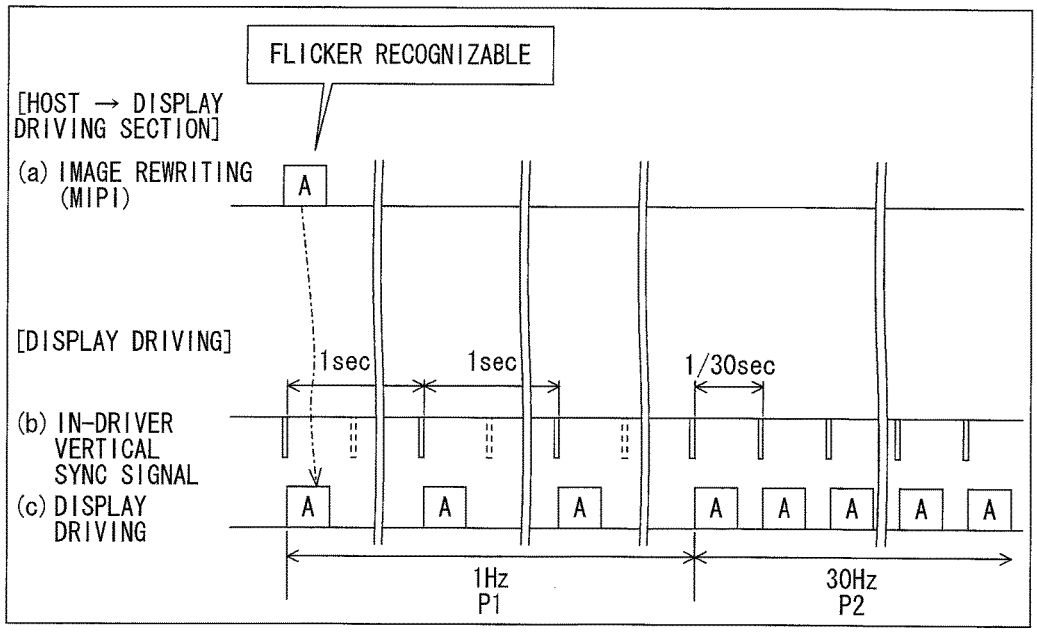
FIG. 6 is a timing chart showing how a still image A is displayed in another embodiment of the present invention.

FIG. 6 is a timing chart showing how a still image A is displayed in Embodiment 2. The image A is a flickering image having a characteristic of causing flicker to be easily recognizable.

After the image A starts to be displayed, the display of the image A is refreshed every second (at 1 Hz) during a first period P1, which is the earliest period. During a second period P2, which follows the first period P1, of a display period in which the image A is displayed, the display of the image A is refreshed every 1/30 seconds (at 30 Hz). For example, the first period P1 lasts five seconds after the image A starts to be displayed, and the second period P2 lasts after the first period P1 until the image A is rewritten to another image. Note that the first period P1 can have any length that is set in accordance with an intended method by which the display device is to be used.

A display device 1 in accordance with Embodiment 2 refreshes a flickering image at a low refresh rate (e.g., equal to or lower than 15 Hz) during the first period P1 (a period of five seconds of the start), which is the earliest period in which a user cannot recognize flicker. After the first period (during the second period P2), the display device 1 continues to drive the display section 10 at a high refresh rate (e.g., higher than 15 Hz) so as to prevent recognition of flicker. Thus, the display device 1 in accordance with Embodiment 2 can prevent flicker from being recognized even by the user who has been carefully viewing the image A for a long time.

During a predetermined period (the first period) which lasts after the image is changed, the display of the image is refreshed at a low refresh rate. Thus, the display device 1 in accordance with Embodiment 2 can also reduce electric power consumption.

Embodiment 3

The following description will discuss a further embodiment of the present invention. For convenience, members similar in function to those described in the foregoing embodiment(s) will be given the same reference signs, and their description will be omitted.

Figure 7:
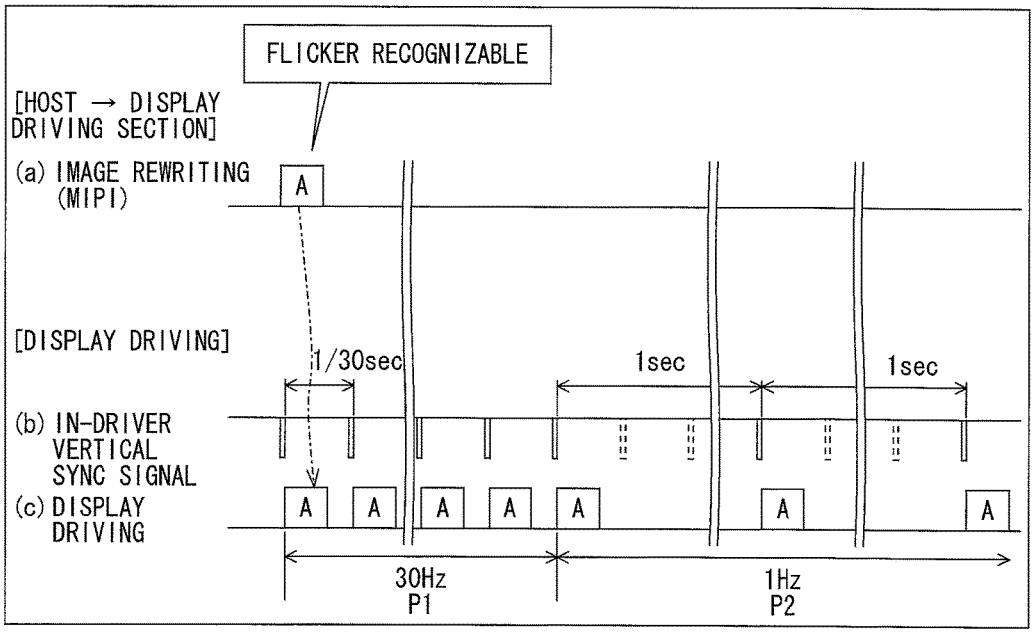
FIG. 7 is a timing chart showing how a still image A is displayed in a further embodiment of the present invention.

FIG. 7 is a timing chart showing how a still image A is displayed in Embodiment 3. The image A is a flickering image having a characteristic of causing flicker to be easily recognizable.

After the image A starts to be displayed, the display of the image A is refreshed every 1/30 seconds (at 30 Hz) during a first period P1, which is the earliest period. During a period (second period P2), which follows the first period P1, of a display period in which the image A is displayed, the display of the image A is refreshed every second (at 1 Hz). For example, the first period P1 lasts five seconds or less after the image A starts to be displayed, and the second period P2 lasts after the first period P1 until the image A is rewritten to another image. Note that the first period P1 can have any length that is set in accordance with an intended method by which the display device is to be used.

A display device 1 in accordance with Embodiment 3 refreshes a flickering image at a high refresh rate (e.g., higher than 15 Hz) during the first period P1 (e.g., a period of five seconds), which is the earliest period in which a user carefully views the image. After the first period (during the second period P2), the display device 1 refreshes the flickering image at a low refresh rate (e.g., equal to or lower than 15 Hz) so as to reduce electric power consumption. Thus, the display device 1 in accordance with Embodiment 3 can prevent flicker from being recognized even during the earliest period, which lasts after the image A starts to be displayed.

After a predetermined period has elapsed since the image was changed (during the second period), the display of the image is refreshed at a low refresh rate. Thus, the display device 1 in accordance with Embodiment 3 can also reduce electric power consumption.

Embodiment 4

The following description will discuss another embodiment of the present invention. For convenience, members similar in function to those described in the foregoing embodiment(s) will be given the same reference signs, and their description will be omitted. According to Embodiment 4, an image determining section and a driving changing section are provided in a substrate other than a host control section. Embodiment 4 differs from the foregoing embodiment(s) in method of changing a refresh rate.

(Configuration of Display Device 2)

Figure 8:
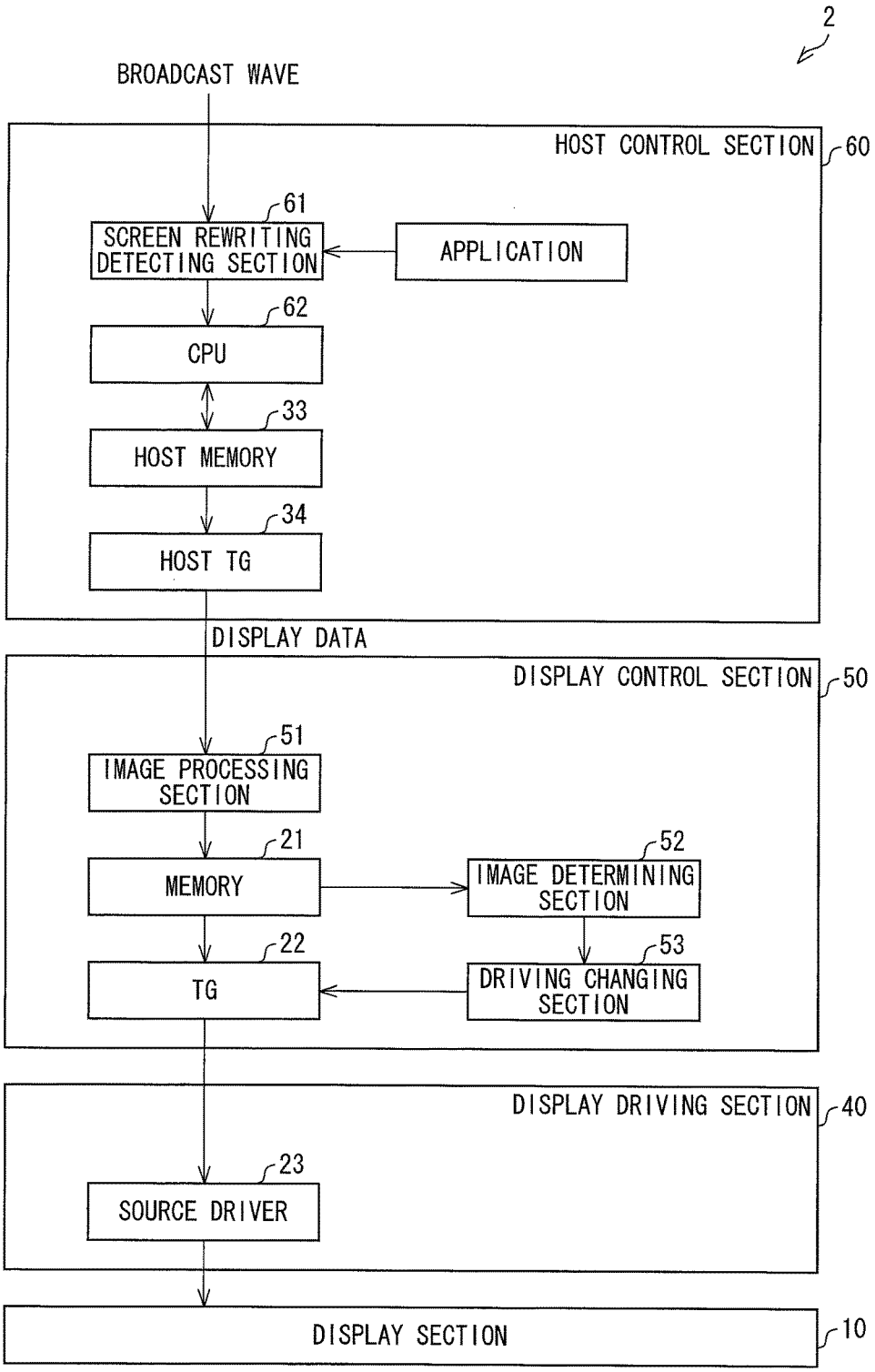
FIG. 8 is a block diagram illustrating a configuration of a display device in accordance with a further embodiment of the present invention.

FIG. 8 is a block diagram illustrating a configuration of a display device in accordance with Embodiment 4. A display device 2 includes a display section 10, a display driving section 40, a display control section 50 (control device), and a host control section 60.

As with Embodiment 1, the display driving section 40 is a COG driver mounted on a glass substrate of the display section 10 by use of the COG technique, and drives the display section 10. The host control section 60 is a control substrate configured by a control circuit provided on a substrate, and is a main component for controlling a host side of the display device 2. The display control section 50 is a control substrate provided apart from the host control section 60 for processing an image to be displayed and the like. According to Embodiment 4, it is the display control section 50 that determines a refresh rate. This allows for a reduction in load of the host control section 60, and therefore makes it possible to secure performance of the host control section 60 for carrying out a process other than displaying an image. This also allows for a reduction in electric power consumption by causing the host control section 60 to pause its operation during a period in which the image is not changed.

(Configuration of Host Control Section 60)

The host control section 60 includes a screen rewriting detection section 61, a CPU 62, a host memory 33, and a host TG 34.

The screen rewriting detection section 61 carries out processes similar to those carried out by the screen writing detection section 31 of Embodiment 1.

The CPU 62 carries out processes similar to those carried out by the CPU 32 of Embodiment 1 except that the CPU 62 does not supply display data to an image determining section.

Only in a case where a display of an image needs to be rewritten, the host TG 34 transfers display data on the image to the display control section 50.

(Configuration of Display Control Section 50)

The display control section 50 includes an image processing section 51, an image determining section 52, a driving changing section 53, a memory 21, and a TG 22.

The image processing section 51 subjects, to image processing such as color adjustment, the display data received from the host control section 60. The image processing section 51 then writes, into the memory 21, the display data which has been subjected to the image processing.

When the display data stored in the memory 21 is rewritten, the image determining section 52 obtains the display data from the memory 21. The image determining section 52 determines whether or not an image based on the display data is a flickering image. The determining process of the image determining section 52 is similar to the process described in the preceding embodiments. The image determining section 52 then supplies a determined result to the driving changing section 53.

According to the determined result of the image determining section 52, the driving changing section 53 (i) determines a refresh rate and (ii) notifies the TG 22 of the refresh rate so as to instruct that the display section 10 be driven at the refresh rate thus determined. In a case where the image based on the display data is not the flickering image in which flicker is easily recognizable, the driving changing section 53 sets a refresh rate at a low refresh rate throughout an entire display period in which the image is displayed. Meanwhile, in a case where the image based on the display data is the flickering image, the driving changing section 53 changes a refresh rate during the display period in which the image is displayed.

In accordance with the refresh rate instructed by the driving changing section 53, the TG 22 (i) reads out the display data from the memory 21 and (ii) transfers the display data to a source driver 23 of the display driving section 40. Note that the TG 22 transfers, in line with the refresh rate, the display data to the display driving section 40 regardless of whether or not an image stored in the memory 21 has been rewritten.

The display driving section 40 includes the source driver 23. The source driver 23 of Embodiment 4 is similar in configuration to that of Embodiment 1.

(Display Driving Method)

Figure 9:
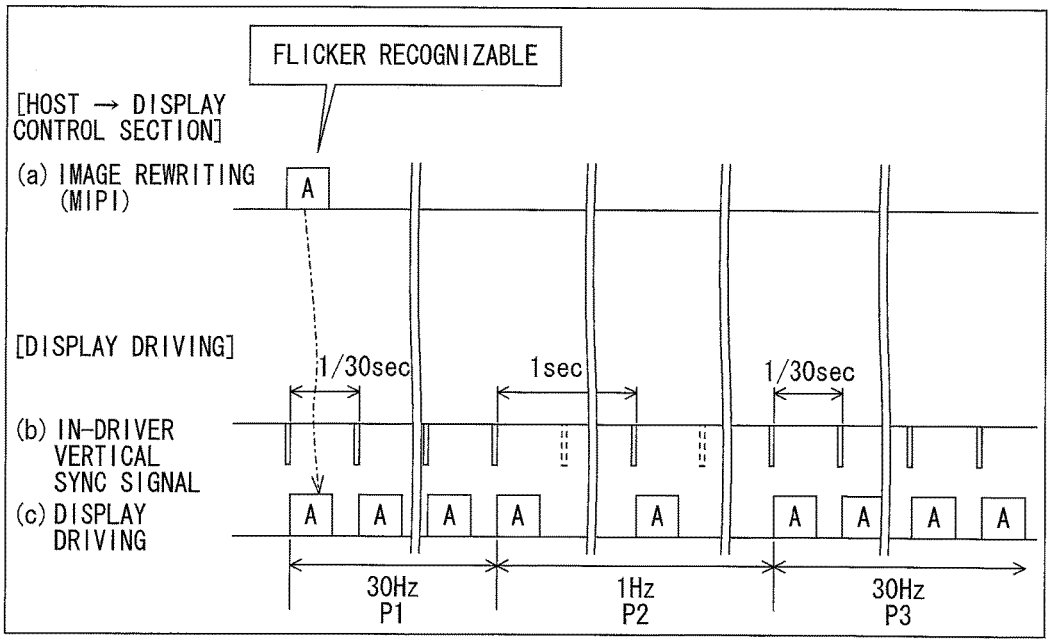
FIG. 9 is a timing chart showing how the display device displays the still image A.

FIG. 9 is a timing chart showing how the display device 2 displays a still image A. The image A is a flickering image having a characteristic of causing flicker to be easily recognizable.

The host control section 60 transfers display data (image A) on one entire screen to the display control section 50 only when content of a screen is changed (see (a) of FIG. 9). After the display data on the image A is transferred, it is when displayed content is rewritten to that of another image that the host control section 60 transfers display data to the display control section 50 next.

The display control section 50 (i) stores the received display data (image A) in the memory 21 and (ii) supplies the display data to the display driving section 40 with a timing in accordance with a determined refresh rate. The display driving section 40 rewrites the image displayed on the display section 10 to the image A in accordance with the received display data ((c) of FIG. 9).

Then, during a first period P1, which is the earliest period, of a display period in which the image A is displayed, a display of the image A is refreshed every 1/30 seconds (at 30 Hz). Specifically, the display control section 50 operates such that the TG 22 reads out display data (the image A) from the memory 21 every 1/30 seconds, and then the source driver 23 supplies the display data to the display section 10. During a second period P2, which follows the first period P1, of the display period in which the image A is displayed, the display of the image A is refreshed every second (at 1 Hz). Further, during a third period P3, which follows the second period P2, of the display period in which the image A is displayed, the display of the image A is refreshed every 1/30 seconds (at 30 Hz). For example, the first period P1 lasts two seconds to three seconds after the image A starts to be displayed, the second period P2 lasts seven seconds to eight seconds after the first period P1, and the third period P3 lasts after the second period until the image A is rewritten to another image.

Note that the first period P1 and the second period P2 can each have any length that is set in accordance with an intended method by which the display device is to be used.

(Effect of Display Device 2)

In order to display a flickering image in which flicker is easily recognizable, the display device 2 of Embodiment 4 displays the flickering image by changing a refresh rate during a display period in which the flickering image is displayed. A user tends to carefully view an image particularly during an initial period that lasts after the image is changed. Thus, the display device 2 refreshes the flickering image at a high refresh rate (e.g., higher than 15 Hz) during the first period P1, which is the earliest period, so as to prevent recognition of flicker. During the second period P2, which follows the first period P1, the display device 2 refreshes the flickering image at a low refresh rate (e.g., equal to or lower than 15 Hz) so as to reduce electric power consumption. However, the user who has been carefully viewing an image for a long time may recognize flicker. Therefore, the display device 2 refreshes the flickering image at a high refresh rate during the third period P3 so as to prevent recognition of flicker. According to Embodiment 4, the refresh rate during the second period P2 is lower than those during the first period P1 and the third period P3. The refresh rate during the first period P1 may be identical to or different from that during the third period P3.

The display device 2 thus changes a refresh rate in accordance with a human visual characteristic so as to display the flickering image. This allows the display device 1 to efficiently achieve both prevention of recognition of flicker and a reduction in electric power consumption. Therefore, with the display device 1, it is possible to reduce electric power consumption while maintaining high display quality.

Further, in a case where an image has no characteristic of causing flicker to be easily recognizable, the display device 1 fixes a refresh rate at a low refresh rate (e.g., equal to or lower than 15 Hz). This allows for a further reduction in electric power consumption.

Embodiment 5

The following description will discuss another embodiment of the present invention. For convenience, members similar in function to those described in the foregoing embodiment(s) will be given the same reference signs, and their description will be omitted. Embodiment 5 is identical to Embodiment 1 or 4 in block configuration of a display device. An image determining method described in Embodiment 5 is applicable to any one of the foregoing embodiments.

(Image Determining Method 1)

In Embodiment 1, what is determined is the percentage of pixels, of all the pixels included in an image, which have grayscale levels falling within a predetermined range. Alternatively, it is possible to determine the percentage of pixels, of all pixels included in part of an image, which have grayscale levels falling within a predetermined range.

Figure 10:
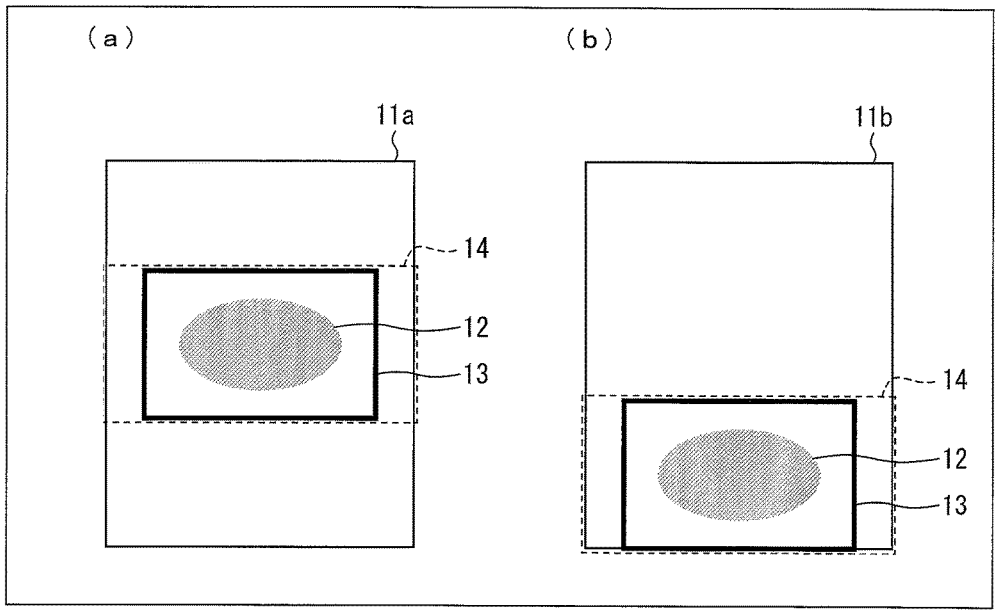
FIG. 10 is a view illustrating screens of the display device.

(a) and (b) of FIG. 10 are views illustrating screens of respective display devices. Uniformity across capacitances of respective pixels depends on a production process. Therefore, a region of a screen of a display device, which region includes pixels having non-uniform capacitances, tends to be concentrated in a certain region. In the example of the display device in (a) of FIG. 10, for example, a region 12, which includes pixels having non-uniform capacitances, is located at a central part of a screen 11*a*. In the example of the display device in (b) of FIG. 10, a region 12, which includes pixels having non-uniform capacitances, is located at a lower part of a screen 11*b*. That is, even in a case where an entire part of a screen displays an image having uniform grayscale levels, (i) flicker in the example shown in (a) of FIG. 10 is easily recognizable at the central part of the screen 11*a* and (ii) flicker in the example shown in (b) of FIG. 10 is easily recognizable in the lower part of the screen 11*b*.

Therefore, it is to be determined whether or not pixels having such grayscale levels that cause flicker to easily occur are distributed throughout a region of the image, which region corresponds to the region 12 including pixels having non-uniform capacitances. This makes it possible to determine whether or not the flicker easily occurs in the image.

According to the display device illustrated in (a) of FIG. 10, an image determining section (region specifying section) 35 or 52 specifies, as a predetermined analysis region 13, a partial region located at the central part of the image. According to the display device illustrated in (b) of FIG. 10, an image determining section specifies, as a predetermined analysis region 13, a partial region located at the lower part of the image. Each of the respective analysis regions 13 of (a) and (b) of FIG. 10 includes a region corresponding to the region 12. The image determining section determines whether or not a first threshold value (e.g. 30%) or a higher percentage of pixels, of all the pixels in the analysis region 13, have grayscale levels falling within a first range (e.g. in a range of grayscale level 20 to grayscale level 80).

The percentage of pixels having intermediate grayscale levels is thus determined only in a partial region of the image, which partial region corresponds to a region of a screen, which region causes flicker to easily occur. This allows for a reduction in amount of process of determining grayscale levels of pixels. In addition, it is possible to reduce a storage capacity that is required for a histogram.

Assume a case where it is determined that flicker easily occurs in the analysis region 13 of the image (i.e. it is determined that the percentage of pixels having grayscale levels within the first range is equal to or higher than the first threshold value). In such a case, it is possible to change not a refresh rate for an entire region of each of the screens 11*a* and 11*b* but only a refresh rate for a partial region 14 of each of the screens 11*a* and 11*b*. Note that, according to an active matrix display device, a signal is inputted into pixels of each scan signal line. Therefore, the display device of each of (a) and (b) of FIG. 10 is capable of refreshing only the region 14 including a plurality of scan signal lines corresponding to the analysis region 13. The display device can refresh a display of an image in the region 14 at refresh rates that are different (e.g., low, high, and low in this order) for each of a plurality of periods, and can refresh a display of an image in a region different from the region 14 at a low refresh rate throughout an entire display period.

(Image Determining Method 2)

Alternatively, the image determining section 35 or 52 can also determine the percentage of pixels, of each of a plurality of regions, which have grayscale levels falling within a predetermined range.

Figure 11:
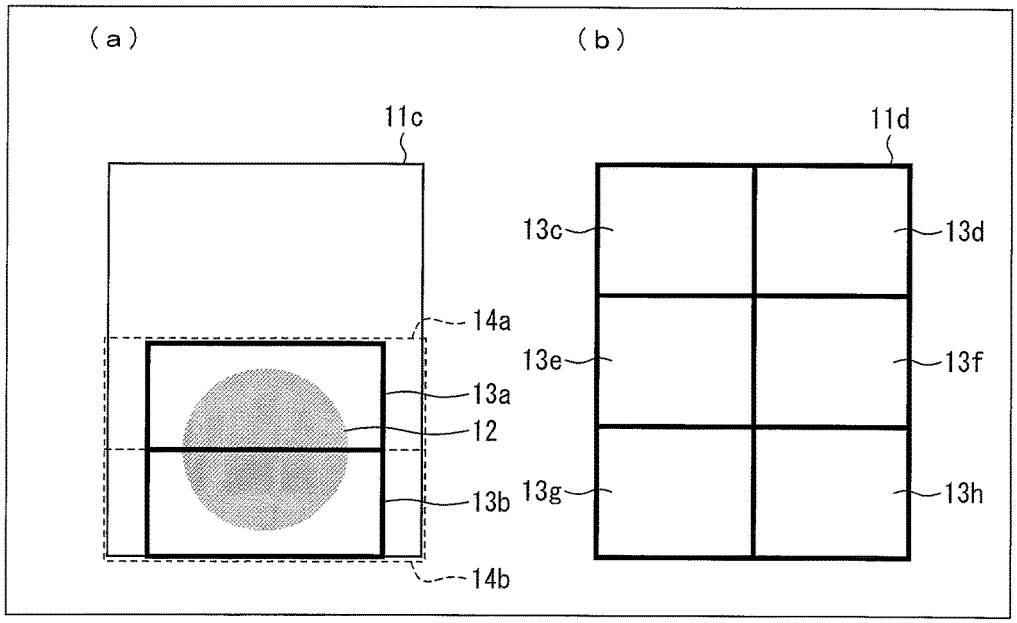
FIG. 11 is a view illustrating screens of the display device.

In an example shown in (a) of FIG. 11, a region 12, which includes pixels having non-uniform capacitances, is located across a center part to a lower part of the screen 11*c*. Therefore, an image determining section 35 sets a plurality of analysis regions 13*a* and 13*b*. Part of the region 12, which part overlaps the center part of the screen 11*c*, is included in the analysis region 13*a*. The other part of the region 12, which part overlaps the lower part of the screen 11*c*, is included in the analysis region 13*b*.

The image determining section determines whether or not the percentage of pixels, of all pixels included in each of the analysis regions 13*a* and 13*b*, which have pixels having grayscale levels within a first range (grayscale levels at each of which flicker is easily recognizable) is equal to or higher than a first threshold value. In a case where it is determined that any one of the analysis regions 13*a* and 13*b* of the image has a characteristic of causing flicker to be easily recognizable (i.e., that the percentage of the pixels having grayscale levels within the first range is equal to or higher than the first threshold value), a refresh rate is changed for at least the one of the analysis regions 13*a* and 13*b* for which one it is determined that the one has the characteristic of causing flicker to be easily recognizable. For example, in a case where the first threshold value or a higher percentage of pixels in the analysis region 13*a* have grayscale levels within the first range, the driving changing section 36 or 53 determines that a region 14*a* of the screen 11*c*, which region 14*a* includes a plurality of scan signal lines corresponding to the analysis region 13*a*, is to be refreshed at refresh rates that are different for each of a plurality of periods.

For example, the region 14*a* of the screen 11*c* is assigned a refresh rate according to the grayscale levels of the plurality of pixels in the analysis region 13*a* to which the region 14*a* corresponds, whereas the region 14*b* of the screen 11*c* is assigned a refresh rate according to the grayscale levels of the plurality of pixel in the analysis region 13*b* to which the region 14*b* corresponds. Any other region of the screen 11*c* is always displayed at a low refresh rate (1 Hz) if the image is a still image. Note that, in a case where it is determined that any one of the analysis regions has the characteristic of causing flicker to be easily recognizable, the driving changing section can be configured to display all the image at the refresh rates that are different for each of the plurality of periods.

Alternatively, as illustrated in (b) of FIG. 11, the image determining section can (i) divide the entire part of the image (screen 11*d*) into a plurality of analysis regions 13*c* through 13*h* and (ii) determine whether or not a first threshold value or a higher percentage of pixels, of all pixels in each of the analysis regions, have grayscale levels falling within a first range. In such a case, the image determining section generates a histogram in which pixels of each of the analysis regions are categorized into a corresponding one of classes. An analysis region 13*c* and an analysis region 13*d* are each driven by common scan signal lines. Therefore, in a case where it is determined that flicker easily occurs (i.e., that a first threshold value or a higher percentage of pixels have grayscale levels within a first range) in at least one of the analysis regions 13*c* and 13*d*, the driving changing section determines that part of the screen 11*d*, which part corresponds to both the analysis region 13*c* and the analysis region 13*d*, is driven at the refresh rates that are different for each of the plurality of periods.

Note that the analysis regions 13*c* through 13*h* can be assigned respective conditions on which to determine the percentage. For example, the image determining section can (i) determine whether or not a first threshold value or a higher percentage of pixels, of all pixels in the analysis region 13*e*, have grayscale levels within a first range and (ii) determine whether or not a second threshold value (that is different from the first threshold value) or a higher percentage of pixels, of all pixels in the analysis region 13*f*, have grayscale levels within a second range (that is different from the first range).

The percentage is thus determined according to each of the plurality of analysis regions. Therefore, even in a case of an image in which such pixels in which flicker is easily recognizable are locally concentrated, it is possible to prevent recognition of flicker by properly changing a refresh rate. In addition, in a case of an image (or region) in which flicker is hardly recognizable, it is possible to reduce electric power consumption by displaying the image (or region) at a low refresh rate.

(Image Determining Method 3)

Alternatively, whether or not an image includes a region in which flicker easily occurs can be determined by determining whether or not the image includes a region that matches a predetermined pattern.

Figure 12:
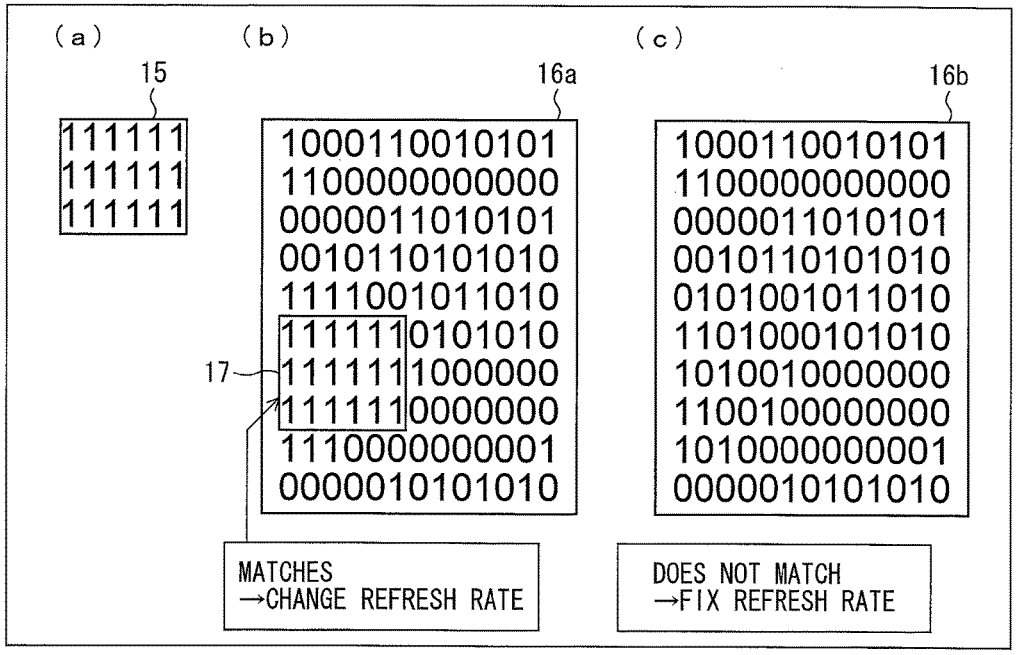
FIG. 12 is a set of views (a) through (c), (a) of FIG. 12 illustrating a predetermined pattern, and (b) and (c) of FIG. 12 each illustrating a grayscale level map indicative of grayscale levels of respective pixels in an image.

(a) of FIG. 12 is a view illustrating a predetermined pattern 15. The pattern 15 is a rectangular pattern made up of 3 lines×6 rows of pixels. The number "1" indicates that a corresponding pixel has a grayscale level falling within a first range (range of grayscale level 20 to grayscale level 80). The number "0" indicates that a corresponding pixel has a grayscale level falling outside the first range. That is, the pattern 15 is a pattern made up of pixels which have grayscale levels within the first range and which are two-dimensionally arranged.

(b) and (c) of FIG. 12 are views each illustrating a grayscale map indicative of grayscale levels of respective pixels in an image. The image determining section (i) determines whether or not pixels in images have grayscale levels within a first range and (ii) generates respective grayscale maps 16*a* and 16*b*. In each of the grayscale maps 16*a* and 16*b*, pixels having grayscale levels within the first range are indicated as "1", whereas pixels having grayscale levels outside the first range are indicated as "0."

As shown by the grayscale map 16*b* in (c) of FIG. 12, even in a case where a large number of pixels have grayscale levels within the first range, flicker is hardly recognizable if such pixels are sparsely dispersed. As shown by the grayscale map 16*a* in (b) of FIG. 12, in a case where a region is locally present in which pixels having grayscale levels within the first range are closely distributed, then flicker is easily recognizable even if a small percentage of pixels of the entire pixels have grayscale levels within the first range. In other words, if pixels having grayscale level within the first range are concentrated in an area that is equal to or larger than a certain region, then flicker is more easily recognizable.

The image determining section determines whether or not each of the grayscale maps 16*a* and 16*b* includes a region that matches the predetermined pattern 15. The driving changing section changes a refresh rate in accordance with whether or not the image includes the region matching the pattern 15.

The grayscale map 16*a* of a given image includes a region 17 that matches the pattern 15. Therefore, the image corresponding to the grayscale map 16*a* causes flicker to easily occur. Therefore, the driving changing section determines that the image is to be displayed at refresh rates that are different for each of a plurality of periods. The grayscale map 16*b* of another image includes no region that matches the pattern 15. Therefore, the image corresponding to the grayscale map 16*b* causes flicker to hardly occur. Therefore, the driving changing section determines that the image is to be displayed at a low refresh rate (fixed at 1 Hz).

The refresh rate is thus determined according to whether or not an image includes a region that matches the predetermined pattern 15. Therefore, recognition of flicker can be prevented by displaying, at the refresh rates that are different for each of the plurality of periods, an image (e.g. image in (b) of FIG. 12) having a local region in which flicker is easily recognizable. In addition, it is possible to reduce electric power consumption by displaying, at a low refresh rate, an image (e.g. image in (c) of FIG. 12) (i) which includes a large number of pixels having grayscale level within the first range and (ii) in which flicker is hardly recognizable.

Alternatively, the driving changing section can determine that only a partial region of the image, which partial region corresponds to a region matching the predetermined pattern 15, is to be displayed at a changing refresh rate. Alternatively, it is possible that, even in a case where a matching rate by which a region included in the image matches the pattern 15 is not 100%, the driving changing section determines that the image is to be displayed at a changing refresh rate if the matching rate is equal to or higher than a predetermined matching rate (e.g., 80%).

Note that in the above described examples, pattern matching is carried out regardless of colors of the pixels. Alternatively, it is possible to carry out pattern matching for each picture element. Specifically, the image determining section can (i) generate a grayscale map indicative of whether or not luminances Y of respective picture elements fall within a predetermined range and (ii) determine whether or not a predetermined pattern constituted by the plurality of picture elements matches an image. Alternatively, the image determining section can (i) generate grayscale maps corresponding to respective R, G, and B colors of a single image and (ii) determine whether or not each of the grayscale maps of the respective colors matches a predetermined pattern.

(Another Image Determining Method)

It is possible to use not only the above image determining method but also another image determining method in which, in a case where a predetermined pattern (e.g., striped pattern) is present in an image, the image determining section determines that the image has the characteristic of causing flicker to be easily recognizable. Pixels having saturated grayscale levels slightly change in potential over time. Thus, in a case where a pixel having an intermediate grayscale level is adjacent to a pixel having a saturated grayscale level (the maximum grayscale level or the minimum grayscale level), flicker is easily recognizable. In a case where an image has such a predetermined pattern, it is possible to prevent recognition of flicker by displaying the image at a changing refresh rate.

Embodiment 6

The following description will discuss another embodiment of the present invention. For convenience, members similar in function to those described in the foregoing embodiment(s) will be given the same reference signs, and their description will be omitted. According to Embodiment 6, a display driving section which is a COG driver includes an image determining section, a driving changing section, and an image processing section.

(Configuration of Display Device 3)

Figure 13:
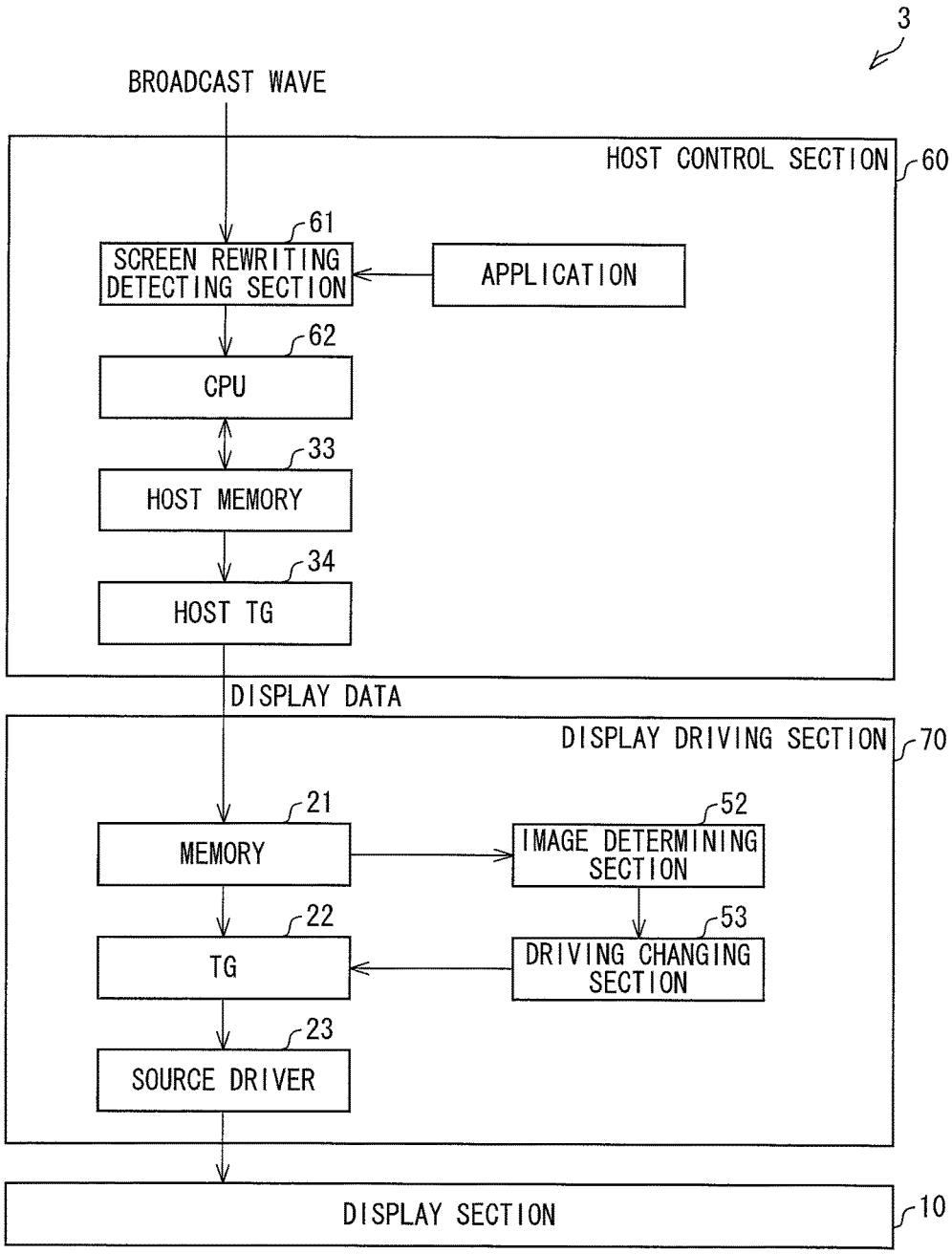
FIG. 13 is a block diagram illustrating a configuration of a display device in accordance with a further embodiment of the present invention.

FIG. 13 is a block diagram illustrating a configuration of a display device in accordance with Embodiment 5. A display device 3 includes a display section 10, a display driving section 70 (control device), and a host control section 60. A configuration of the host control section 60 is similar to that in Embodiment 4. Only in a case where a display of an image needs to be rewritten, the host control section 60 transfers display data on the image to the display driving section 70.

The display driving section 70 is a COG driver mounted on a glass substrate of the display section 10 by use of the COG technique, and drives the display section 10. The display driving section 70 includes an image determining section 52, a driving changing section 53, a memory 21, a TG 22, and a source driver 23. Operations of the members included in the display driving section 70 are similar to those described in Embodiment 4.

According to Embodiment 6, it is the COG driver (display driving section 70) that determines a refresh rate. This makes it possible to reduce a load of the host control section 60 without providing a substrate in addition to the host control section 60. Note that a surface area by which COG driver is mounted on an active matrix substrate is limited. Therefore, Embodiment 6 is suitable for a case where the image determining section 52 and the driving changing section 53 carry out a simple determining process.

SUMMARY

The control device (host control section 30, display control section 50, and display driving section 70) in accordance with Aspect 1 of the present invention is a control device for a display device (1, 2, or 3), the control device including: an image determining section (35 or 52) for determining whether or not an image has a characteristic of causing flicker to be easily recognizable; and a refresh rate determining section (driving changing section 36 or 53) for, in a case where the image determining section determines that the image has the characteristic of causing flicker to be easily recognizable, for a first period and a second period that are included in a display period in which the image is displayed, the first period being followed by the second period, determining (i) that a display of the image is to be refreshed at a first refresh rate during the first period and (ii) that the display of the image is to be refreshed at a second refresh rate during the second period, the second refresh rate being different from the first refresh rate.

According to the above configuration, it is possible to change a refresh rate in accordance with a human visual characteristic so as to display a flickering image having a characteristic of causing flicker to be easily recognizable. This allows the control device to efficiently achieve both prevention of recognition of flicker and a reduction in electric power consumption. Therefore, with the display device, it is possible to reduce electric power consumption while maintaining high display quality.

The control device in accordance with Aspect 2 of the present invention can be configured in Aspect 1 such that the first period is the earliest period of the display period, and the second refresh rate is higher than the first refresh rate.

The control device in accordance with Aspect 3 of the present invention can be configured in Aspect 2 such that the refresh rate determining section determines that the display of the image is to be refreshed at a third refresh rate during a third period, the third refresh rate being lower than the second refresh rate, the third period being included in the display period and following the second period.

The control device in accordance Aspect 4 of the present invention can be configured in Aspect 2 or 3 such that the first refresh rate is equal to or lower than 15 Hz.

The control device in accordance with Aspect 5 of the present invention can be configured in any one of Aspects 2 through 4 such that, in a case where the image determining section determines that the image has no characteristic of causing flicker to be easily recognizable, the refresh rate determining section determines that the display of the image is to be refreshed at a fourth refresh rate, which is lower than the second refresh rate.

The control device in accordance with Aspect 6 of the present invention can be configured in Aspect 1 such that the first period is the earliest period of the display period, and the second refresh rate is lower than the first refresh rate.

The control device in accordance with Aspect 7 of the present invention can be configured in Aspect 6 such that the refresh rate determining section determines that the display of the image is to be refreshed at a third refresh rate during a third period, the third refresh rate being higher than the second refresh rate, the third period being included in the display period and following the second period.

The control device in accordance with Aspect 8 of the present invention can be configured in Aspect 6 or 7 such that the first refresh rate is higher than 15 Hz.

The control device in accordance with Aspect 9 of the present invention can be configured in any one of Aspects 6 through 8 such that, in a case where the image determining section determines that the image has no characteristic of causing flicker to be easily recognizable, the refresh rate determining section determines that the display of the image is to be refreshed at a fourth refresh rate, which is lower than the first refresh rate.

The control device in accordance with Aspect 10 of the present invention can be configured in any one of Aspects 1 through 9 such that, in accordance with whether or not a percentage of pixels, of all pixels in a given region of the image, which have grayscale levels falling within a range of grayscale levels that are set in advance as grayscale levels which fall within a range of intermediate grayscale levels and at each of which flicker is easily recognizable, is equal to or higher than a threshold value, the image determining section determines whether or not the image has the characteristic of causing flicker to be easily recognizable.

The display device in accordance with Aspect 11 of the present invention includes a control device of any one of Aspects 1 through 10.

The control method in accordance with Aspect 12 of the present invention is a method for controlling a display device, the method including the steps of: (a) determining whether or not an image has a characteristic of causing flicker to be easily recognizable; and (b) in a case where it is determined in the step (a) that the image has the characteristic of causing flicker to be easily recognizable, for a first period and a second period that are included in a display period in which the image is displayed, the first period being followed by the second period, determining (i) that a display of the image is to be refreshed at a first refresh rate during the first period and (ii) that the display of the image is to be refreshed at a second refresh rate during the second period, the second refresh rate being different from the first refresh rate.

The present invention is not limited to the embodiments, but can be altered by a skilled person in the art within the scope of the claims. An embodiment derived from a proper combination of technical means each disclosed in a different embodiment is also encompassed in the technical scope of the present invention. Further, it is possible to form a new technical feature by combining the technical means disclosed in the respective embodiments.

INDUSTRIAL APPLICABILITY

The present invention is applicable to a display device.

REFERENCE SIGNS LIST

1, 2, 3 Display device
10 Display section
20, 40, 70 Display driving section (control device)
30, 60 Host control section (control device)
35, 52 Image determining section
36, 53 Driving changing section (refresh rate determining section)
50 Display control section (control device)
P1 First period
P2 Second period
P3 Third period

The invention claimed is:

1. A control device for a display device, said control device comprising:

an image determining section that determines whether or not grayscale levels of a plurality of pixels in an image fall within a predetermined range including intermediate grayscale levels; and a refresh rate determining section, wherein in a case where the image determining section determines that a percentage of pixels, of all pixels in a given region of the image, which have grayscale levels falling within the predetermined range of grayscale levels, is equal to or higher than a threshold value, the refresh rate determining section determines, for a first period and a second period in both of which periods the same image is continuously displayed, the first period being followed by the second period, (i) that a display of the same image is to be refreshed at a first refresh rate during the first period and (ii) that the display of the same image displayed in the first period is to be refreshed at a second refresh rate during the second period, the second refresh rate being different from the first refresh rate.

2. The control device as set forth in claim 1, wherein:

the first period is the earliest period of a display period in which the same image is continuously displayed; and the second refresh rate is higher than the first refresh rate.

3. The control device as set forth in claim 2, wherein the refresh rate determining section determines that the display of the image is to be refreshed at a third refresh rate during a third period, the third refresh rate being lower than the second refresh rate, the third period being included in the display period in which the same image is continuously displayed and following the second period.

4. The control device as set forth in claim 2, wherein the first refresh rate is equal to or lower than 15 Hz.

5. The control device as set forth in claim 2, wherein, in a case where the image determining section determines that the percentage of the pixels which have the grayscale levels falling within the predetermined range of grayscale levels is lower than the threshold value, the refresh rate determining section determines that the display of the image is to be refreshed at a fourth refresh rate, which is lower than the second refresh rate.

6. The control device as set forth in claim 1, wherein:

the first period is the earliest period of a display period in which the same image is continuously displayed; and the second refresh rate is lower than the first refresh rate.

7. The control device as set forth in claim 6, wherein the refresh rate determining section determines that the display of the image is to be refreshed at a third refresh rate during a third period, the third refresh rate being higher than the second refresh rate, the third period being included in the display period in which the same image is continuously displayed and following the second period.

8. The control device as set forth in claim 6, wherein the first refresh rate is higher than 15 Hz.

9. The control device as set forth in claim 6, wherein, in a case where the image determining section determines that the percentage of the pixels which have the grayscale levels falling within the predetermined range of grayscale levels is lower than the threshold value, the refresh rate determining section determines that the display of the image is to be refreshed at a fourth refresh rate, which is lower than the first refresh rate.

10. A display device comprising a control device recited in claim 1.

11. A method for controlling a display device, said method comprising:

(a) determining whether or not grayscale levels of a plurality of pixels in an image fall within a predetermined range including intermediate grayscale levels; and (b) in a case where it is determined in the step (a) that a percentage of pixels, of all pixels in a given region of the image, which have grayscale levels falling within the predetermined range of grayscale levels, is equal to or higher than a threshold value, the refresh rate determining section determines, for a first period and a second period in both of which periods the same image is continuously displayed, the first period being followed by the second period, determining (i) that a display of the same image is to be refreshed at a first refresh rate during the first period and (ii) that the display of the same image displayed in the first period is to be refreshed at a second refresh rate during the second period, the second refresh rate being different from the first refresh rate.

* * * * *